US005449253A

United States Patent [19]

Roger

[11] Patent Number: 5,449,253

[45] Date of Patent: Sep. 12, 1995

[54] METHOD AND APPARATUS FOR DRIVING A TUBE INTO THE GROUND BY HAMMERING, IN PARTICULAR FOR MAKING A FOUNDATION PILE

[75] Inventor: Pierre Roger, Bois-Colombes, France

[73] Assignee: Bouygues Offshore, Montigny-le-Bretonneux, France

[21] Appl. No.: 99,525

[22] Filed: Jul. 30, 1993

[30] Foreign Application Priority Data

Jul. 31, 1992 [FR] France ..... 92 09559

[51] Int. Cl.[6] ..... E02D 7/28

[52] U.S. Cl. ..... 405/245; 405/232

[58] Field of Search ..... 405/228, 232, 245, 249, 405/253, 246, 247; 173/125, 206, 210, 212

[56] References Cited

U.S. PATENT DOCUMENTS

| | | | |
|---|---|---|---|
| 2,693,087 | 11/1954 | Quillinan | 405/253 |
| 3,714,787 | 2/1973 | Clements et al. | 405/245 |
| 4,102,408 | 7/1978 | Ludvigson | 405/232 X |

FOREIGN PATENT DOCUMENTS

| | | | |
|---|---|---|---|
| 2171492 | 9/1973 | France . | |
| 2592414 | 7/1987 | France . | |
| 3715 | 1/1981 | Japan | 405/245 |
| 7454 | 5/1909 | United Kingdom | 405/245 |

*Primary Examiner*—David H. Corbin

*Attorney, Agent, or Firm*—Jacobson, Price, Holman & Stern

[57] ABSTRACT

The tube is hammered by means of a hydraulic or an electromagnetic hammer pressed against a pile-driving head situated at the bottom of the tube. The bottom of the tube is preferably provided with a hammering bearing surface and a removable head is used that is suitable for resisting laterally on said bearing surface. The invention is particularly applicable to providing piles or stakes, particularly for a foundation.

10 Claims, 3 Drawing Sheets

METHOD AND APPARATUS FOR DRIVING A TUBE INTO THE GROUND BY HAMMERING, IN PARTICULAR FOR MAKING A FOUNDATION PILE

The invention relates to a method and apparatus for driving a tube into the ground by hammering, e.g. for the purpose of providing a stake or pile, in particular for providing foundations on land, in a harbor, or at sea.

BACKGROUND OF THE INVENTION

A known technique for hammering a tube so as to form a pile consists in closing the bottom end of the pile with a plug of strong material, in particular concrete, thereby defining a pile-driving head, and in hammering said head by dropping a mass inside the tube.

Variants of the above technique consist in replacing the plug of strong material with a metal cover (French patent 85 19405). Another known technique is to provide the bottom portion of the tube with a shoulder against which a pointed metal plug bears, which plug is struck by dropping a metal mass (French patent 72 03451).

The major drawbacks of those various systems are the following:

When using a concrete plug, tube penetration is ensured only by friction between the plug and its envelope, and the method is incapable of making piles of great length.

When a cover is used, the pile-driving head cannot be recovered and when a metal plug is used special tools are required to recover it. Unfortunately, it may be necessary to remove the pile-driving head in order to drill through a hard region of ground that cannot be passed through by hammering or in order to perform reconnaissance concerning the ground of a foundation.

All of those methods function poorly or not at all when hammering piles that are inclined, and they work even less well with curved piles as are used quite frequently for guiding the top portions of oil boreholes.

That is why most pile-driving is performed by means of pile-drivers striking a helmet covering the head of such a tube.

The major drawbacks of such head-end striking system are as follows:

The hammering energy required for achieving a determined amount of pile insertion is nearly always greater than the energy that would be required if hammering had been performed at the bottom of the pile.

The thickness of the wall of the pile is determined much more often by the value of the hammering shock force that needs to be withstood than by the final load applied to the pile, thereby giving rise to wasted additional expense.

A head-end hammering system is always very noisy which often means it cannot be used in a built-up area.

When driving very long piles, e.g. for off-shore oil platforms, the head-end hammering technique does not enable the state of the bottom end of the pile to be thoroughly inspected, and when such inspections are performed after the event, it is often observed that a tube is crushed.

OBJECTS AND SUMMARY OF THE INVENTION

The present invention seeks to remedy the above-described drawbacks.

To do this, it proposes a hammering technique whereby the hammering energy is applied to the bottom end of the tube by means of a special hammer.

According to the invention, the bottom portion of the tube is provided with an internal lateral bearing surface, a pile-driving head is applied against said bearing surface with the top portion of the head being movable in a cage that is secured to a hydraulic or an electromagnetic hammer, the head being fitted with a leading ground-penetrating point which projects from the bottom end of the tube when the head bears against the bearing surface, and the hammer is controlled to transmit the hammering energy to the head via the top end or the bottom end of the cage depending on whether the tube is to be driven down or the head is to be extracted.

The bottom portion of the tube is provided with a transverse and lateral internal pile-driving bearing surface that leaves at least the major portion of the right cross-section of the tube disengaged.

In particularly advantageous embodiments, the invention further includes one or more of the following characteristics:

damping means are interposed between the pile-driving head and the bearing surface enabling the hammering energy transmission curve to be transformed; and coupling means are interposed between the pile-driving head and the bearing surface enabling the head to be raised relative to the bearing surface while maintaining coupling and also making it possible to decouple the head and the bearing surface thus making it possible, at will, to use the hammering energy for driving both the head and the tube simultaneously or for driving only the head or the tube.

BRIEF DESCRIPTION OF THE DRAWINGS

The above technique and its advantages are described below with reference to the figures of the accompanying drawings, with the description and the figures showing up other important aspects of the invention.

In the figures.

MORE DETAILED DESCRIPTION

Figure 1:
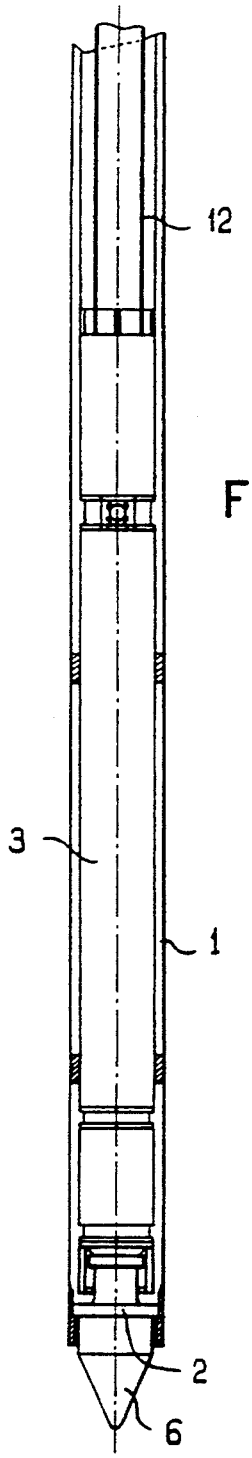
FIG. 1 is a vertical axial section through a tube fitted with a device of the invention for driving the tube into the ground.

FIG. 1 essentially shows a tube 1 having a hydraulic hammer 3 fitted with a pile-driving head 2 installed therein.

The pile-driving head 2 bears against a bearing surface which is constituted in this example by an annular collar 4 formed inside the tube 1 close to the bottom end of the tube. The collar may be manufactured simultaneously with the tube or it may be machined in the tube, or it may be added to the tube, in which case it may be made of a material other than that of the tube.

The tube 1 may be made of concrete, for example, and the collar 4 may be provided by an annular shoe 5 of steel added to the tube and constituting the bottom end of the tube.

Figure 2:
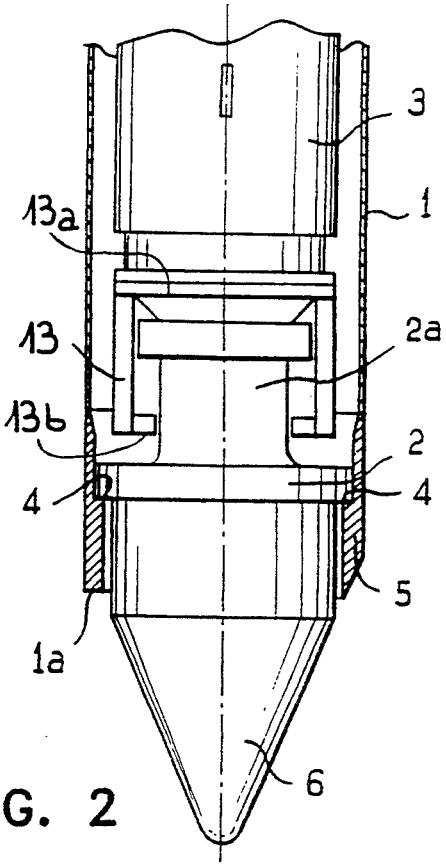
FIG. 2 is an enlarged view of the bottom end of the FIG. 1 tube.
Figure 3:
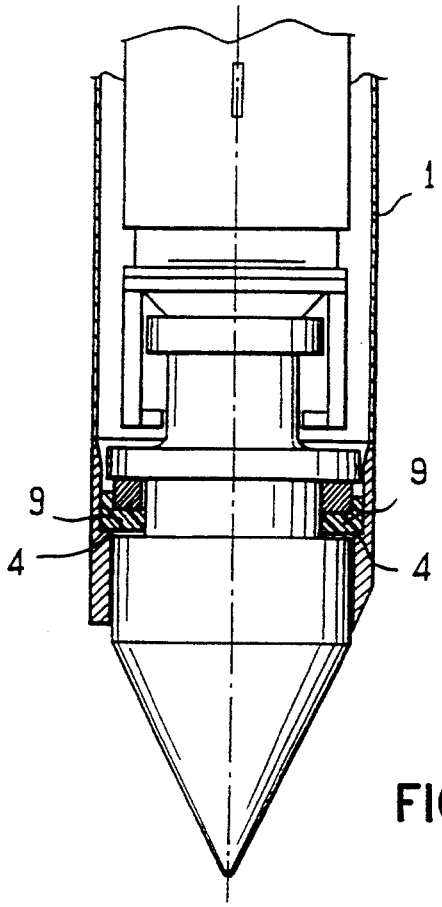
FIG. 3 is an axial section analogous to FIG. 2 but for the case where damping means are interposed between the pile-driving head and the hammering thrust surface of the tube.

The pile-driving head 2 is fitted with a leading penetration point 6 which projects through the bottom end of the tube when the head bears against the collar (FIG. 2). The head may be made of steel, concrete, or some other material, in conventional manner.

For example, the point may be a conical steel point, optionally filled with ballast.

The means for constituting the hammering bearing surface inside the tube may be more complex than a mere collar.

It is often advantageous to interpose continuous or discontinuous damping means 9 between the pile-driving head 2 and the hammering bearing surface, as shown in FIGS. 3 to 6, for example.

The damping means serve to transmit to the tube only a fraction of the hammering energy applied to the head.

Figure 4:
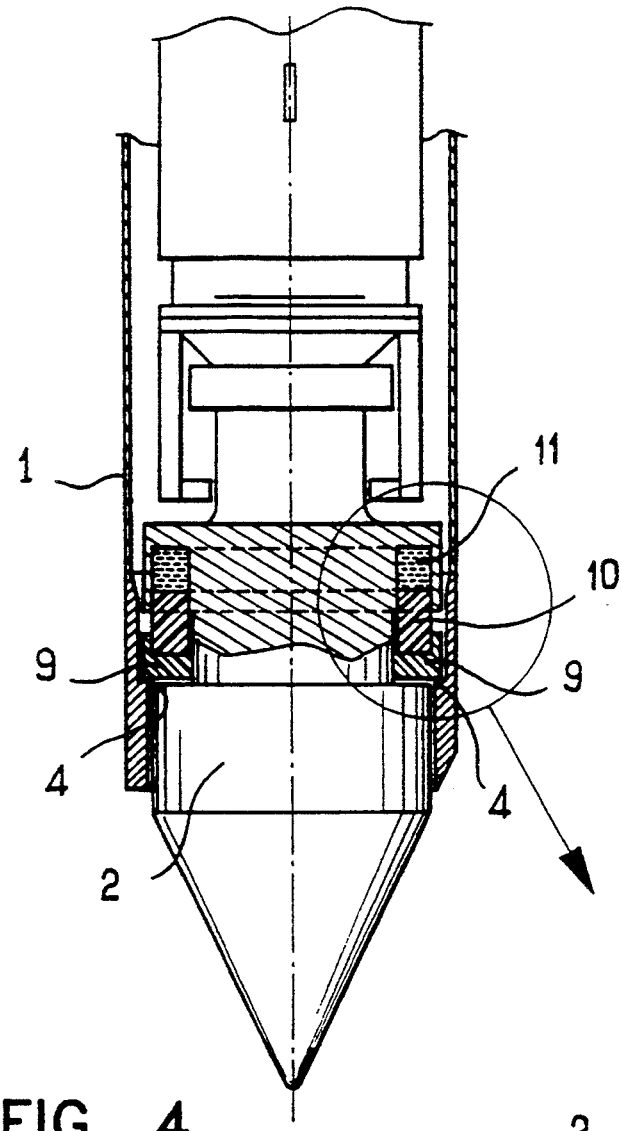
FIG. 4 is an axial section analogous to FIG. 2 but for the case where a decoupling actuator is interposed between the pile-driving head and the hammering thrust surface of the tube.
Figure 5:
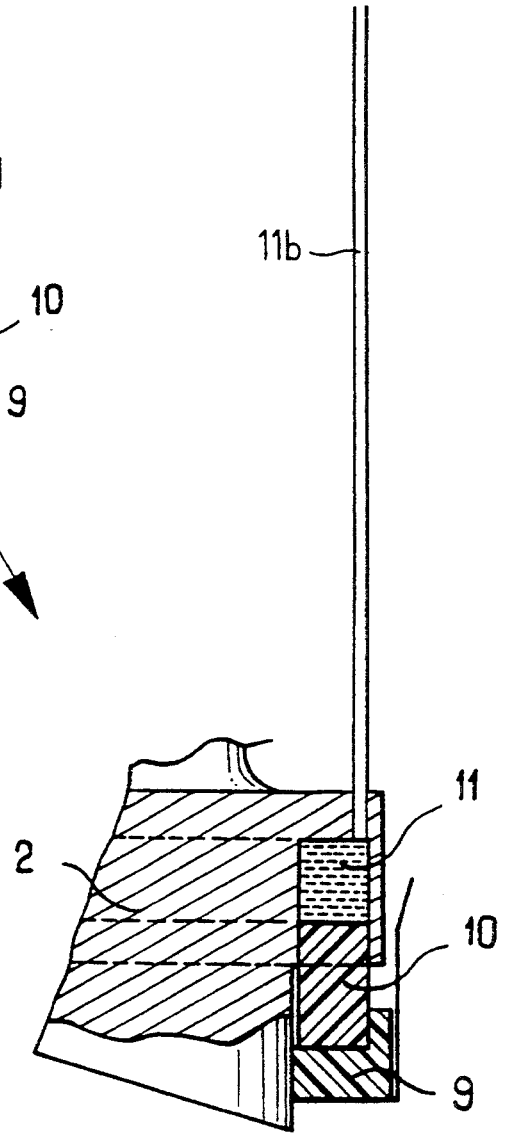
FIG. 5 is a detail view on a larger scale of the decoupler actuator of FIG. 5.

In the embodiment of FIGS. 4 to 6, an annular actuator is also interposed between the hammering bearing surface 4 and the pile-driving head 2, which actuator is constituted by an annular piston 10 and a chamber 11 containing a hydraulic fluid that can be connected to an exhaust circuit.

FIGS. 6A, 6B, 6C, and 6D illustrate the operation of such a device.

When the chamber is not connected to the exhaust, the head 2 and the bearing surface 4 are coupled together and hammering the head causes the head to move downwards on its own until the actuator is in its fully retracted state.

When the actuator is fully retracted (FIG. 6A) the head can be raised by admitting oil into the chamber 11 until the actuator takes up a fully extended condition (FIG. 6B), and if the chamber is then closed off, subsequent hammering of the head will cause both the head and the tube to be moved downwards simultaneously.

Figures 6A, 6B, 6C, 6D:
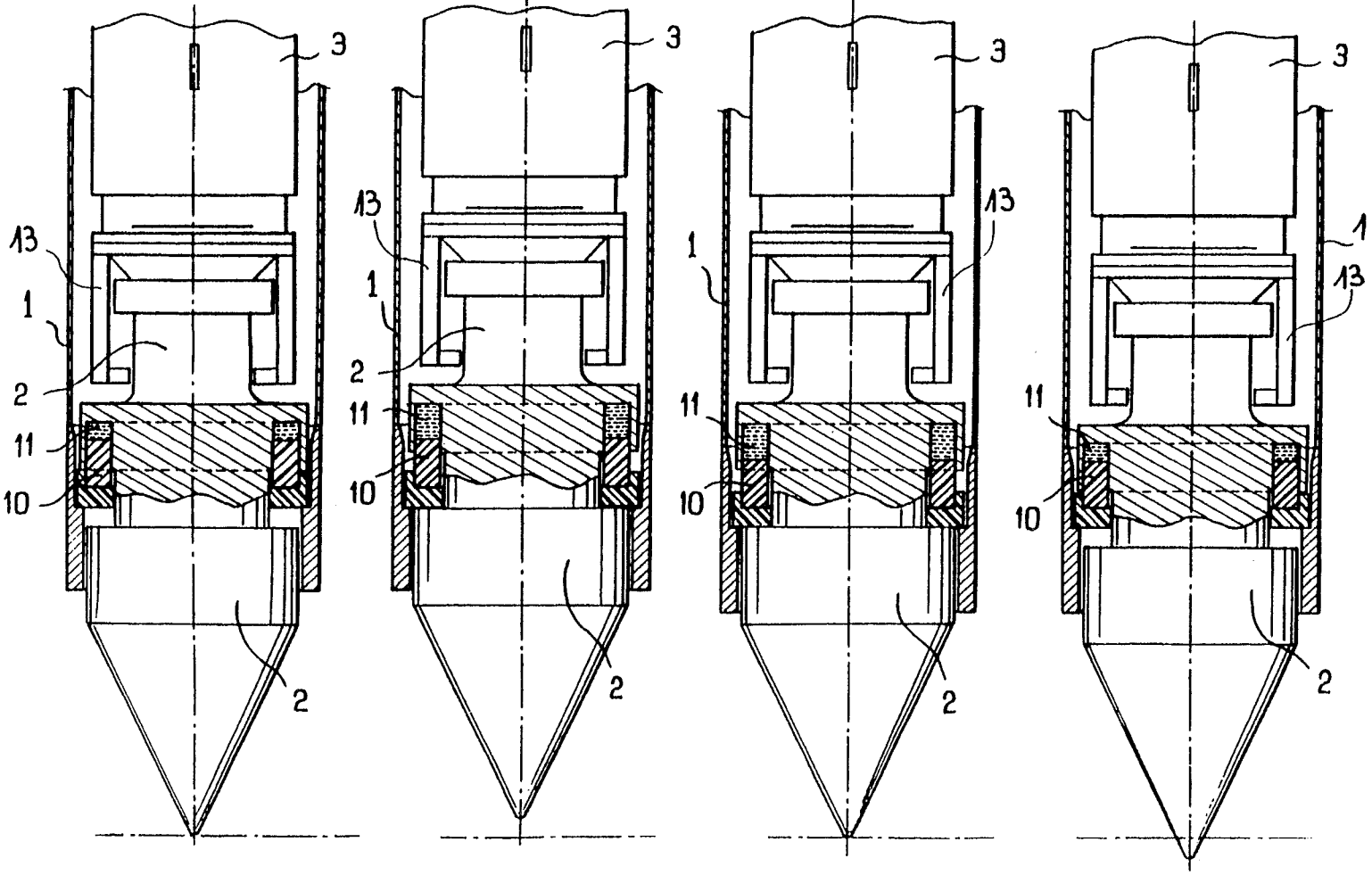
FIG. 6 is a diagram showing different stages in a tube hammering operation with the device of FIG. 4, the actuator being in a fully retracted condition (FIG. 6A), then in a fully extended condition (FIG. 6B), the head being subsequently hammered with the actuator maintained in the fully extended condition (FIG. 6C) and the head being further hammered with the actuator allowed to returned to the fully retracted condition (FIG. 6D).

If the stroke of the actuator is adjusted to correspond to the hammer stroke, then the head returns to the position it occupied before being raised (FIG. 6C) and the system behaves as though on going from the configuration of FIG. 6A to the configuration of FIG. 6C, the head does not move and only the tube is lowered. In contrast, starting from the configuration of FIG. 6C where the actuator is at full extension, by hammering the head while connecting the actuator chamber to the exhaust circuit, the head can be caused to move downwards while the tube does not move (FIG. 6D).

The annular actuator 10, 11 thus makes it possible to use the hammering energy for driving the head only, the tube only, or both the head and the tube simultaneously.

It is preferable to use a hydraulic hammer 3 fed via an umbilical cord 12 for hammering the head. Such hammers are known per se (cf. for example, publications EP-A-0 206 384 and EP-A-0 095 801), and comprise a striking mass that moves in a chamber in one direction under drive from a hydraulic fluid and in the opposite section under drive from gravity, preferably combined with the effect of a hydraulic fluid.

The hammer shown in the figures includes a cage 13 secured to the hammer within which the top portion **2*a* of the pile-driving head 2 can move while held captive in the cage between a top end 13*a* and a bottom shoulder 13*b*** of the cage.

Such a structure makes it possible to use the energy of the hammer either to drive the head and the tube, or else to extract the head from the tube by reversing the direction of the hammer strokes.

While driving, it is the top end **13*a*** of the cage that transmits the hammering energy to the head in the driving direction.

For extraction purposes, it is the bottom end **13*b*** of the cage that transmits the hammering energy to the head in the extraction direction.

The invention is not limited to the embodiments described.

Hydraulic or electromagnetic hammers enable curved piles to be made if the curvature of the pile is compatible with the length of the hammer and does not prevent the hammer being installed and withdrawn.

The invention is not limited to the above embodiments.

The tube 1 could be used on its own if its wall thickness and strength are sufficient for a foundation, in which case it could be filled in conventional manner with a settable material such as concrete.

The tube may be made of any suitable material, and it is preferable to use tubes made of steel or of concrete. The ends of the tubes may be straight or chamfered.

I claim:

1. A method of driving a tube into the ground, by hammering, which comprises:

providing a lower portion of the tube with a transverse and lateral internal hammering bearing surface leaving at least a major fraction of the right cross-section of the tube disengaged;

providing a hammer insertable in the tube and comprising a cage, said hammer having a reversible hammering direction and said cage having a top end adapted to transmit the hammering energy in said direction and a bottom end adapted to transmit the hammering energy in the reverse direction;

providing a pile-driving head adapted to be inserted into said tube and supported by said bearing surface, said head having a top portion movable between said top end and said bottom end of said cage in order that the said top portion may be coupled either to said top end of the cage or to said bottom end of the cage, said head having a leading ground-penetrating point projecting from the bottom end of the tube when said head is supported by said bearing surface;

inserting said head within said tube in order that said head be supported by said bearing surface;

coupling said top portion of the head and said top end of the cage and controlling the hammer to transmit the hammering energy downward to the head via said top end of the cage to drive down the head and the tube in the ground; and coupling said top portion of the head and said bottom end of the cage and reversing the hammering direction to transmit the hammering energy upward to the head via said bottom end of the cage for extracting the head from the tube.

2. A method according to claim 1, which comprises interposing damping means between the pile-driving head and the hammering bearing surface for the purpose of transmitting to the tube only a fraction of the hammering energy that is applied to the head.

3. A method according to claim 1, which comprises interposing coupling means between the head and said bearing surface, the coupling means being controllable to raise the head relative to the bearing surface.

4. A method according to claim 3, which comprises providing an annular actuator said coupling means.

5. A method according to claim 3, which comprises stages consisting in controlling said coupling means to raise the head upward without moving the tube, and thereafter hammering the head to drive the tube and the head, the head being returned to the position it occupied prior to being raised.

6. A method according to claim 3, which comprises stages consisting of decoupling said head from said bearing surface and hammering the head to drive the head without driving the tube.

7. A device for driving a tube into the ground, by hammering, which comprises:

means for providing a lower portion of the tube with a transverse and lateral internal hammering bearing surface leaving at least a major fraction of the right cross-section of the tube disengaged;

a hammer insertable in the tube and comprising a cage, said hammer having a reversible hammering direction and said cage having a top end adapted to transmit the hammering energy in said direction and a bottom end adapted to transmit the hammering energy in the reverse direction;

a pile-driving head adapted to be inserted into said tube and supported by said bearing surface, said head having a top portion movable between said top end and said bottom end of said cage in order that the said top portion may be coupled either to said top end of the cage or to said bottom end of the cage, said head having a leading ground-penetrating point projecting from the bottom end of the tube when said head is supported by said bearing surface.

8. Device according to claim 7, including damping means interposed between the hammering bearing surface and the pile-driving head.

9. Device according to claim 7, including coupling means interposed between the head and the tube and controllable to raise the head with respect to the bearing surface.

10. Device according to claim 9, wherein said coupling means are constituted by an annular actuator interposed between the head and the hammering bearing surface.

* * * * *